US009302861B2

(12) United States Patent
Hirata et al.

(10) Patent No.: US 9,302,861 B2
(45) Date of Patent: Apr. 5, 2016

(54) SHEET FEED TRAY, SHEET FEED DEVICE, AND IMAGE FORMING APPARATUS

(71) Applicants: Munekazu Hirata, Kanagawa (JP); Mitsutaka Nakamura, Hyogo (JP); Takashi Fujimoto, Hyogo (JP); Kozo Yamazaki, Hyogo (JP); Toshio Yamaki, Osaka (JP)

(72) Inventors: Munekazu Hirata, Kanagawa (JP); Mitsutaka Nakamura, Hyogo (JP); Takashi Fujimoto, Hyogo (JP); Kozo Yamazaki, Hyogo (JP); Toshio Yamaki, Osaka (JP)

(73) Assignee: Ricoh Company, LTD., Tokyo (JP)

( * ) Notice: Subject to any disclaimer, the term of this patent is extended or adjusted under 35 U.S.C. 154(b) by 0 days.

(21) Appl. No.: 14/533,776

(22) Filed: Nov. 5, 2014

(65) Prior Publication Data

US 2015/0123341 A1 May 7, 2015

(30) Foreign Application Priority Data

Nov. 7, 2013 (JP) ..... 2013-231223

(51) Int. Cl.
*B65H 1/04* (2006.01)

(52) U.S. Cl.
CPC ..... *B65H 1/04* (2013.01); *B65H 2402/62* (2013.01); *B65H 2405/1142* (2013.01); *B65H 2405/11164* (2013.01); *B65H 2405/324* (2013.01); *B65H 2407/21* (2013.01); *B65H 2511/12* (2013.01); *B65H 2511/22* (2013.01); *B65H 2701/11312* (2013.01); *B65H 2801/03* (2013.01)

(58) Field of Classification Search
CPC .. B65H 2511/11; B65H 2511/12; B65H 1/04; B65H 2405/1142; B65H 2701/11312
USPC ..... 271/171
See application file for complete search history.

(56) References Cited

U.S. PATENT DOCUMENTS

| | | | | |
|---|---|---|---|---|
| 4,693,620 | A * | 9/1987 | Harumatsu | 400/611 |
| 5,292,112 | A * | 3/1994 | Hirota et al. | 271/3.03 |
| 5,511,770 | A * | 4/1996 | Okazaki | 271/4.01 |
| 5,927,702 | A * | 7/1999 | Ishii | B65H 5/36 271/171 |
| 6,648,327 | B1 * | 11/2003 | Lin | B65H 7/10 271/171 |
| 8,041,283 | B2 * | 10/2011 | Murai | B65H 29/70 271/188 |
| 8,401,456 | B2 * | 3/2013 | Kano | B65H 1/266 271/9.09 |
| 8,925,854 | B2 * | 1/2015 | Chen et al. | 242/578.1 |
| 9,036,221 | B2 * | 5/2015 | Ohta | H04N 1/00519 358/474 |
| 2006/0232000 | A1 * | 10/2006 | Takahashi et al. | 271/145 |

(Continued)

FOREIGN PATENT DOCUMENTS

| | | |
|---|---|---|
| JP | 5-238607 | 9/1993 |
| JP | 2006-298509 | 11/2006 |

(Continued)

OTHER PUBLICATIONS

U.S. Appl. No. 14/320,720, filed Jul. 1, 2014.

*Primary Examiner* — Jeremy R Severson
(74) *Attorney, Agent, or Firm* — Harness, Dickey & Pierce, P.L.C.

(57) ABSTRACT

A sheet feed tray to stack a sheet to be conveyed to an image forming apparatus includes a platen on which a first portion of the sheet is placed; a pair of first support portions to support a second portion of the sheet folded back upward at a trailing end of the first portion; and a pair of second support portions to support a third portion of the sheet folded back upward at a trailing end of the second portion. In the sheet feed tray, the first support portions and the second support portions are reciprocally movable toward each other, and a distance between the second support portions is wider than a distance between the first support portions.

16 Claims, 18 Drawing Sheets

(56) References Cited

U.S. PATENT DOCUMENTS

| | | | | |
|---|---|---|---|---|
| 2008/0084021 | A1 | 4/2008 | Nakamura | |
| 2009/0045566 | A1 | 2/2009 | Nakamura | |
| 2010/0225053 | A1 | 9/2010 | Nakamura et al. | |
| 2012/0248687 | A1 * | 10/2012 | Takahata et al. | 271/253 |
| 2013/0106050 | A1 | 5/2013 | Nishii et al. | |
| 2014/0091518 | A1 | 4/2014 | Nishii et al. | |
| 2014/0239578 | A1 | 8/2014 | Honda et al. | |

FOREIGN PATENT DOCUMENTS

| | | |
|---|---|---|
| JP | 2009-078894 | 4/2009 |
| JP | 2010-013277 | 1/2010 |

* cited by examiner

SHEET FEED TRAY, SHEET FEED DEVICE, AND IMAGE FORMING APPARATUS

CROSS-REFERENCE TO RELATED APPLICATIONS

The present application claims priority pursuant to 35 U.S.C. §119(a) from Japanese patent application number 2013-231223, filed on Nov. 7, 2013, the entire disclosure of which are incorporated by reference herein.

CROSS-REFERENCE TO RELATED APPLICATIONS

The present application claims priority pursuant to 35 U.S.C. §119(a) from Japanese patent application number 2013-231223, filed on Nov. 7, 2014, the entire disclosure of which are incorporated by reference herein.

BACKGROUND

1. Technical Field

Exemplary embodiments of the present invention relate to a sheet feed tray on which a plurality of sheets to be fed to an image forming apparatus is stacked, a sheet feed device including the sheet feed tray, and the image forming apparatus incorporating the sheet feed device.

2. Background Art

Image forming apparatuses such as copiers, printers, facsimile machines, and multi-function devices having one or more capabilities of the above devices include in general a sheet feed tray. The sheet feed tray is becoming more compact as image forming apparatuses continue to shrink in size. As a result, it has become difficult to accommodate a long sheet when a long sheet is used for printing.

Accordingly, an approach has been attempted in which the long sheet is folded back on itself and stacked in the image forming apparatus. FIG. 31 shows an example of a sheet feed tray, in which a pair of side fences 300 is disposed on a tray body 200 and a guide member 400 including an upper guide plate 401 and a lower guide plate 402 is mounted to the pair of side fences 300. In this case, as illustrated in FIG. 32, a sheet P is placed on the tray body 200, the lower guide plate 402, and the upper guide plate 401 so that the sheet P can be placed in the folded state.

However, in the above sheet feed tray, when a long sheet is placed, the sheet is passed between the upper guide plate and the lower guide plate, complicating placement. In addition, when the sheet is thick or there are a large number of the sheets, the bundle of sheets exerts stiffness and folding it back is difficult, thereby making it difficult to place the sheet in the apparatus.

SUMMARY

In one embodiment of the disclosure, there is provided an improved sheet feed tray to stack a sheet to be conveyed to an image forming apparatus. The sheet feed tray includes a platen on which a first portion of the sheet is placed; a pair of first support portions to support a second portion folded back upward at a trailing end of the first portion; and a pair of second support portions to support a third portion folded back upward at a trailing end of the second portion. In the sheet feed tray, the first support portion and the second support portion are respectively disposed in pairs and are reciprocally movable toward each other, and a distance between the pair of second support portions is wider than the distance between the pair of first support portions.

There is also provided a sheet feed device that includes the sheet feed tray as described above, and a sheet feed unit to convey a sheet placed on the platen to an image forming apparatus. Further, an image forming apparatus including the sheet feed device as described above is provided.

These and other objects, features, and advantages of the present invention will become apparent upon consideration of the following description of the preferred embodiments of the present invention when taken in conjunction with the accompanying drawings.

DETAILED DESCRIPTION

Figure 1:
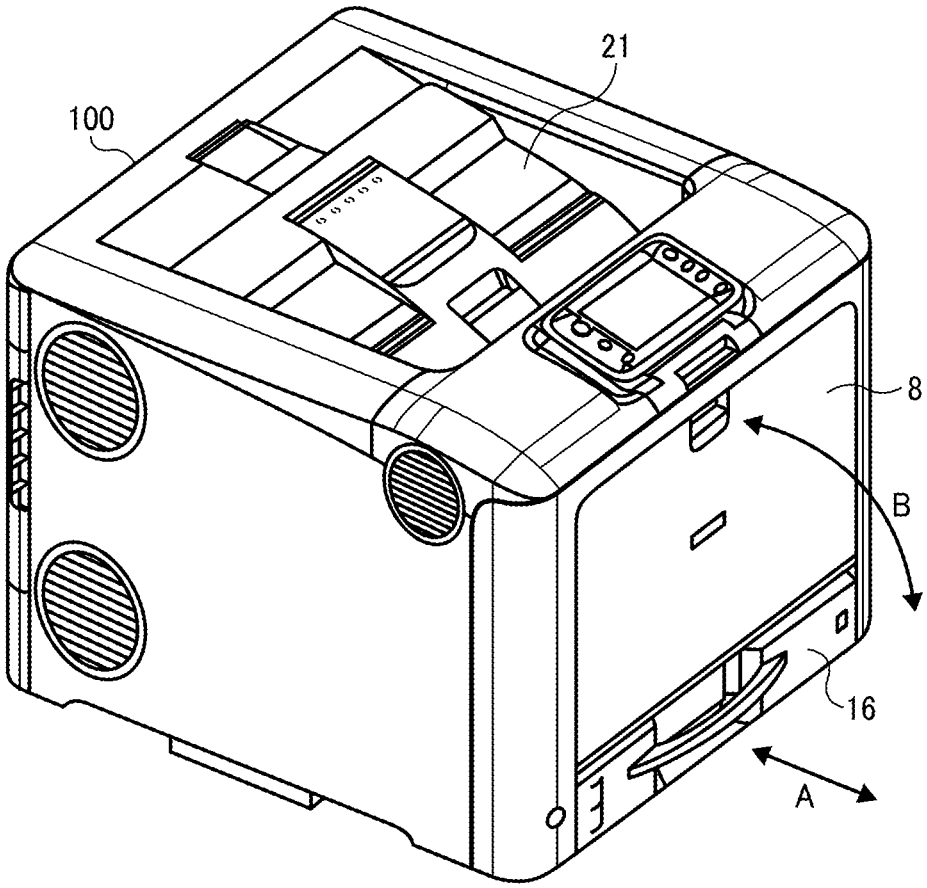
FIG. 1 is a perspective view of a laser printer as an image forming apparatus according to an embodiment of the present invention.

Hereinafter, preferred embodiments of the present invention will be described referring to the accompanying drawings. In each of the following drawings, parts or components having the same function or shape will be given the same reference numeral as long as it can be identified, and once explained, a redundant description thereof will be omitted.

Figure 2:
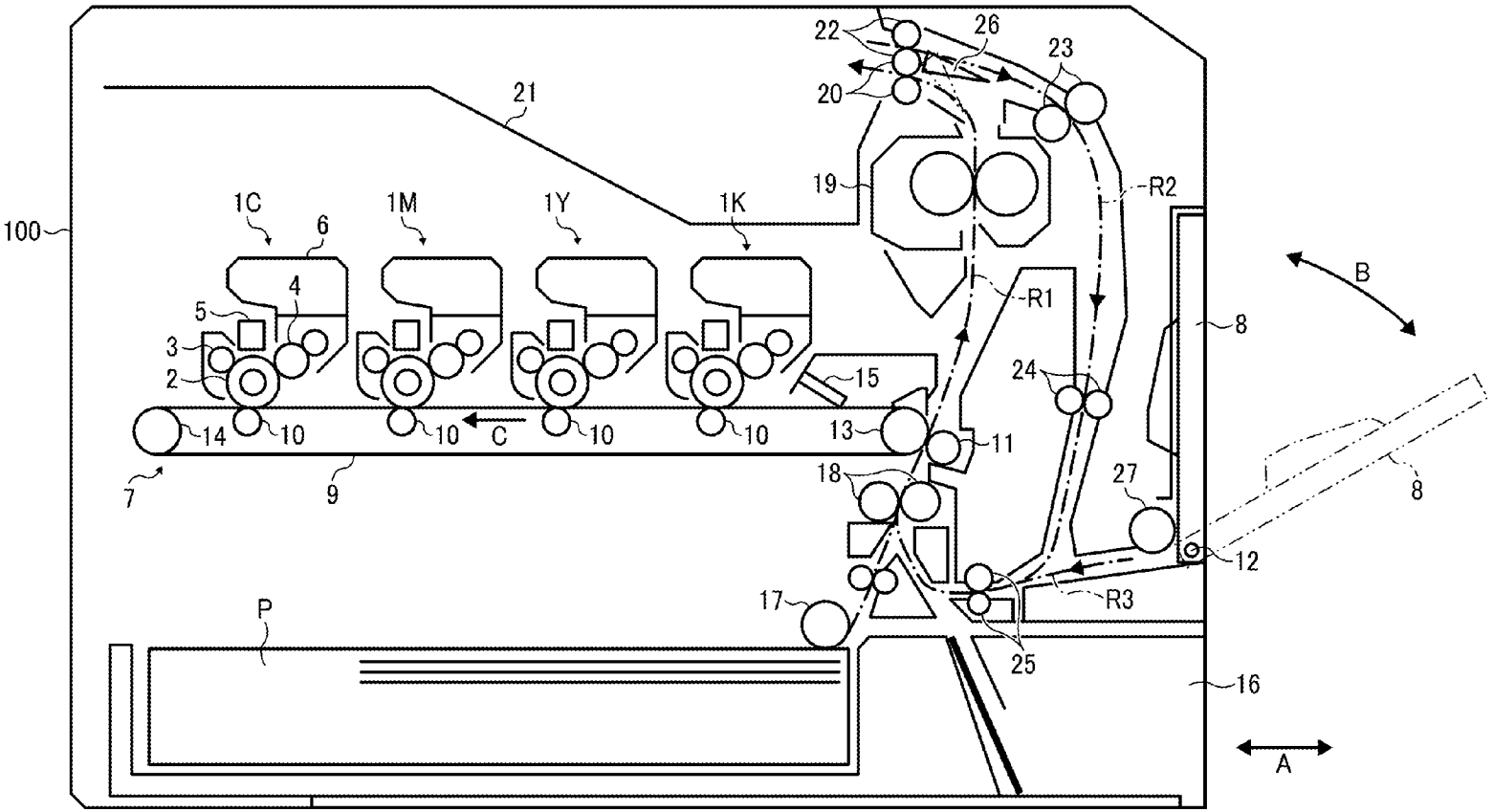
FIG. 2 is a schematic cross-sectional view of the laser printer of FIG. 1.

FIG. 1 is a perspective view of a laser printer as an image forming apparatus according to an embodiment of the present invention. FIG. 2 is a cross-sectional view of the laser printer of FIG. 1.

A laser printer is described as an image forming apparatus according to the present invention; however, embodiments implemented by the present invention may be applied to any of copiers, facsimile machines, printers, inkjet recording apparatuses, and multi-functional apparatuses including at least two functions of the above apparatuses in combination. In addition, "sheet" means a medium to which developer or ink can be adhered, including a sheet of paper, an OHP sheet, fabrics, and the like. Further, the "sheet" includes, other than a regular sheet, various types of sheets such as a cardboard, a postcard, an envelope, thin paper, coated paper or art paper, tracing paper, and the like. In the embodiments that will be described later, these various types of sheets are referred to simply as a sheet.

As illustrated in FIG. 1, the image forming apparatus 1 includes an apparatus body 100. A sheet feed tray 16 to contain multiple sheets is disposed in the bottom of the apparatus body 100. The sheet feed tray 16 is drawable from and insertable to the apparatus body 100 in arrow A direction in FIG. 1. In addition, the image forming apparatus 1 according to the present embodiment includes a sheet feed tray 8 on which a manually-fed sheet is placed. The manual sheet feed tray 8 is openably closable relative to the apparatus body 100 in arrow B direction in FIG. 1. More specifically, as illustrated in FIG. 2, the manual sheet feed tray 8 pivots about a rotary shaft 12 disposed below the apparatus body 100. In addition, a sheet discharge tray 21 to stack the sheet discharged outside the apparatus is disposed on an upper surface of the apparatus body 100.

Hereinafter, a main section of the image forming apparatus 1 will be described based on FIG. 1.

The image forming apparatus 1 includes, as an image forming section, four process units 1K, 1Y, 1M, and 1C, each of which forms an image using a developer of each color of black, yellow, magenta, and cyan, corresponding to color separation components of a color image. Each of the process units 1K, 1Y, 1M, and 1C has the same structure except that each contains a different color of unused toner.

A structure of the process unit 1C will be described as a representative example. The process unit 1C includes a photoreceptor 2 as an image carrier to carry an image thereon; a charging roller 3 to charge a surface of the photoreceptor 2; a developing device 4 to render a latent image formed on the photoreceptor 2 visible; and a cleaner to clean the surface of the photoreceptor 2. Each of the four process units 1K, 1Y, 1M, and 1C is detachably attached to the apparatus body 100 and consumable parts included in each process unit are replaceable at once.

An LED head array 5 to expose the surface of the photoreceptor 2 and form the latent image thereon is disposed at a position opposed to each photoreceptor 2. A toner cartridge 6 serving as a developer container is detachably attached above each developing device 4.

A transfer device 7 is disposed underneath each of the process units 1K, 1Y, 1M, and 1C. The transfer device 7 includes an intermediate transfer belt 9 serving as an intermediate transfer body; four primary transfer rollers 10 each serving as a primary transfer member; and a secondary transfer roller 11 as a secondary transfer member. The intermediate transfer belt 9 is formed of an endless belt and is stretched around a drive roller 13, a driven roller 14, and the primary transfer rollers 10. When the drive roller 13 rotates in the counterclockwise direction as illustrated in FIG. 2, the intermediate transfer belt 9 is driven to rotate in a direction as indicated by Arrow C in FIG. 2.

Each primary transfer roller 10 presses an interior surface of the intermediate transfer belt 9 at a position opposite each photoreceptor 2, and a primary transfer nip is formed at a position where the pressed portion of the intermediate transfer belt 9 contacts each photoreceptor 2. In addition, each primary transfer roller 10 is connected to a power source and a predetermined direct current (DC) voltage and/or alternating current (AC) voltage is supplied to the primary transfer rollers 10.

The secondary transfer roller 11 presses an external surface of the intermediate transfer belt 9 at a position opposite the drive roller 13 and a secondary transfer nip is formed at a position where the secondary transfer roller 11 contacts the intermediate transfer belt 9. In addition, similarly to the primary transfer rollers 10, the secondary transfer roller 11 is connected to the power source and a predetermined direct current (DC) voltage and/or alternating current (AC) voltage is supplied to the secondary transfer roller 11.

A belt cleaner 15 configured to clean the surface of the intermediate transfer belt 9 is disposed on a circumference of the intermediate transfer belt 9. Waste toner removed by the belt cleaner 15 is collected in a waste toner container.

A sheet feed tray 16 to contain a plurality of sheets P as recording media and a sheet feed roller 17 to convey each sheet P from the sheet feed tray 16 are disposed in the bottom of the apparatus body 100. A conveyance path R1 through which the sheet conveyed from the sheet feed tray 16 is conveyed is disposed inside the apparatus body 100. A pair of registration rollers 18 serving as a timing roller to convey the sheet to the secondary transfer nip at an appropriate timing for conveyance and a fixing device 19 to fix an unfixed image onto the sheet are disposed in the conveyance path R1. Further, a pair of sheet discharge rollers 20 to discharge the sheet outside the apparatus body is disposed at the end of the conveyance path R1.

In addition, the printer according to the present embodiment includes a reverse conveyance path to convey the sheet by reversing it for a duplex printing. Specifically, the reverse conveyance path includes a pair of reverse conveyance rollers 22 to reverse and convey the sheet to a reverse path R2, and a plurality of conveyance roller pairs 23, 24, and 25 to convey the sheet inside the reverse path R2. In the present embodiment, one of the pair of sheet discharge rollers 20 is shared with one of the pair of reverse conveyance rollers 22. Further, a switcher 26 to switch the sheet conveyance path is disposed downstream of the fixing device 19 in the sheet conveyance direction. The switcher 26 is configured to move such that the path to guide the sheet between the pair of sheet discharge rollers 20 or the path to guide the sheet between the pair of reverse conveyance rollers 22 can be selected.

In addition, the printer according to the present embodiment includes a manual sheet feed roller 27 to convey the sheet from the manual sheet feed tray 8 and a manual sheet conveyance path R3 through which the sheet conveyed by the manual sheet feed roller 27 is guided to the reverse path R2.

Next, with reference to FIG. 2, basic operation of the printer according to an embodiment of the present invention will be described.

When an image forming operation is started, each photoreceptor 2 of each of the process units 1K, 1Y, 1M, and 1C is driven by a driving device, not shown, to rotate in a clockwise direction as illustrated in FIG. 2, and each surface of the photoreceptor 2 is uniformly charged at a predetermined polarity by the charging roller 3. Based on image data from an image reader or from a computer, the surface of each photoreceptor 2 is exposed to the exposure light from the LED head array 5 and an electrostatic latent image is formed on the charged surface of each photoreceptor 2. In this case, the image data exposed on each photoreceptor 2 is monochrome image data decomposed, from the target full-color image, into color data of black, yellow, magenta, and cyan. Each developing device 4 supplies toner to the electrostatic latent image formed on the photoreceptor 2, and the electrostatic latent image is visualized as a toner image.

Upon a start of image forming operation, the intermediate transfer belt 9 is driven to rotate. Then, because the constant voltage or the constant-current controlled voltage with a polarity opposite that of the toner is applied to each of the primary transfer rollers 10, a transfer electric field is formed in the primary transfer nip between each of the primary transfer rollers 10 and each photoreceptor 2.

Thereafter, upon the toner image of each color formed on the photoreceptor 2 reaching the primary transfer nip associated with the rotation of each photoreceptor 2, the toner image of each color formed on each photoreceptor 2 is sequentially transferred in a superimposed manner on the intermediate transfer belt 9 by the transfer electric field formed in the primary transfer nip. Thus, a full-color toner image is carried on the surface of the intermediate transfer belt 9.

A sheet feed roller 17 disposed in the bottom of the apparatus body 100 starts to rotate so that the sheet P is fed out from the sheet feed tray 16 to the conveyance path R1. The sheet P fed out to the conveyance path R1 is once stopped by a registration roller pair 18.

Then, the registration roller pair 18 starts to rotate at a predetermined timing so that the sheet P is conveyed to the secondary transfer nip at a matched timing with which the toner image on the intermediate transfer belt 9 has reached the secondary transfer nip. In this case, because the transfer voltage having a polarity opposite that of the charged toner of the toner image on the intermediate transfer belt 9 is applied to the secondary transfer roller 11, a transfer electric field is formed at the secondary transfer nip. Through the electric transfer field formed at the secondary transfer nip, the toner image on the intermediate transfer belt 9 is transferred en bloc to the sheet P. In addition, the residual toner which has not been transferred to the sheet P and is remaining on the intermediate transfer belt 9 is removed by a belt cleaner 15.

Thereafter, the sheet P is conveyed to the fixing device 19, and the toner image on the sheet P is fixed by the fixing device 19 onto the sheet P. Then, the sheet P is introduced to a portion between the pair of sheet discharge rollers 20 by the switcher 26 disposed in an orientation as shown by a solid line in the figure, and is discharged by the pair of sheet discharge rollers 20 onto the sheet discharge tray 21.

When a duplex printing is performed, the switcher 26 is swung in a direction as shown by a chained line of FIG. 2, and the sheet the toner image on one side of which has been fixed is guided between the pair of reverse conveyance rollers 22. Then, before the trailing end of the sheet passes through the position between the pair of reverse conveyance rollers 22, the pair of reverse conveyance rollers 22 is rotated and the sheet is conveyed to the reverse path R2. The sheet sent to the reverse path R2 is conveyed by the plurality of conveyance roller pairs 23, 24, and 25, and is again conveyed to the conveyance path R1. Then, after the toner image is transferred and fixed on the reverse side of the sheet similarly to the above, the sheet P is introduced to a portion between the pair of sheet discharge rollers 20 by the switcher 26 switched to a direction as shown by the solid line in FIG. 2, and is discharged on the sheet discharge tray 21.

When the sheet is fed through the manual sheet feed tray 8, the manual sheet feed tray 8 is swung in an opening direction up to a position as shown by a chained line, and the sheet is placed thereon. When the manual sheet feed roller 27 rotates, the sheet is fed toward the manual sheet conveyance path R3 and is introduced to the conveyance path R1 via a conveyance roller pair 25 disposed downstream of the reverse path R2. Then, after the toner image is transferred and fixed on the sheet similarly to the above, the sheet is discharged onto the sheet discharge tray 21.

The explanation heretofore relates to a full-color image forming operation; however, alternatively a monochrome image may be formed using any one of the four process units 1K, 1Y, 1M, and 1C, and an image using two or three colors may be formed by using two or three process units.

Figure 3:
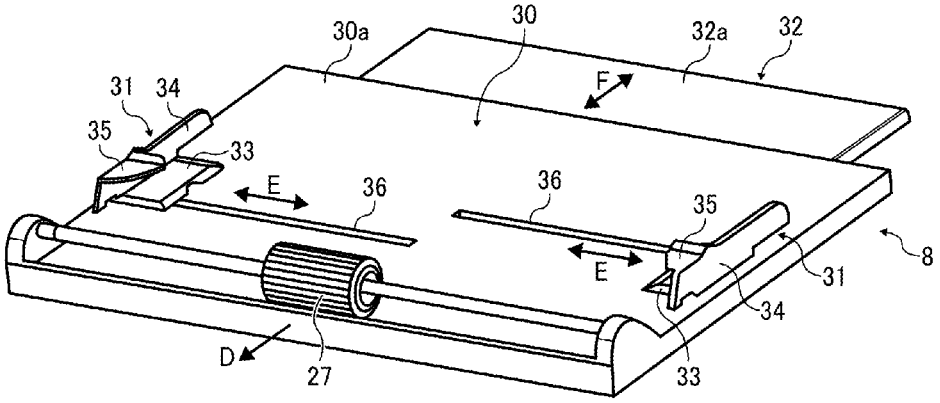
FIG. 3 is a perspective view of a sheet feed device disposed in the laser printer of FIG. 1.

FIG. 3 is a perspective view of a sheet feed device formed of the manual sheet feed tray 8 and a manual sheet feed roller 27.

In the description below, as to the sheet feed device, a proximal side means a side near the image forming apparatus and a distal side means a side opposite and farther from the image forming apparatus. In FIG. 3, an arrow D shows a direction along which the sheet is fed.

As illustrated in FIG. 3, the manual sheet feed tray 8 includes a main body 30 of the tray, a pair of side fences 31, and an extension tray 32. The main body 30 is attached to the apparatus body 100 of the image forming apparatus 1 with a front end thereof pivotally about the rotary shaft 12 (see FIG. 2). In addition, when the main body 30 is horizontally set as illustrated in FIG. 3 or when the manual sheet feed tray 8 is open as illustrated in FIG. 2, an upper surface 30*a* of the main body 30 serves as a platen on which the sheet is placed. In the present embodiment, the manual sheet feed roller 27 is mounted at the front end of the main body 30 of the tray, but may be disposed on the apparatus body 100.

Each of the pair of side fences 31 is symmetrically disposed against each other and includes a bottom wall 33, a side wall 34, and an upper wall 35. The bottom wall 33 is disposed parallel to the upper surface 30*a*, the side wall 34 is vertically uplifted from the bottom wall 33, and the upper wall 35 is disposed on an upper end of the side wall 34 and substantially parallel to the bottom wall 33. Each side fence 31 reciprocally moves along a guide channel 36 formed on the main body 30 (that is, arrow E direction in FIG. 3). When the both side fences 31 are moved toward each other with the sheet placed on the main body 30 until the side walls 34 contact both sides of the sheet in the width direction, the position of the sheet is set in the width direction. In addition, in this state, each end of the sheet in the width direction is positioned in a space between the bottom wall 33 and the upper wall 35 and the upper wall 35 prevents the sheet from moving upward.

The extension tray 32 is movable in the front-back direction (in arrow F direction in FIG. 3), and is switchable between an extended state in which the extension tray 32 is extended from a trailing end of the main body 30 to a distal side and an installed state in which the extension tray 32 is installed in the main body 30. When the extension tray 32 is extended, even though the sheet has a length exceeding the depth of the main body 30, the extension tray 32 can receive the trailing end of the sheet. In addition, as to the extension tray 32, when the main body 30 is horizontally set as illustrated in FIG. 3 or when the manual sheet feed tray 8 is open as illustrated in FIG. 2, an upper surface 32*a* of the extension tray 32 serves as a platen on which the sheet is placed.

When the extension tray 32 is extended, even the sheet with a length exceeding the depth of the main body 30 can be placed. However, a further longer sheet is to be placed, the extension tray 32 is not enough and the trailing end of the sheet falls down to attach the floor. Then, when a particularly long sheet is placed on the sheet feed tray according to the present invention, the following long sheet supporter is attached.

Hereinafter, details of the long sheet supporter will be described.

FIGS. 4 to 8 illustrate a first embodiment of the present invention.

Figure 4:
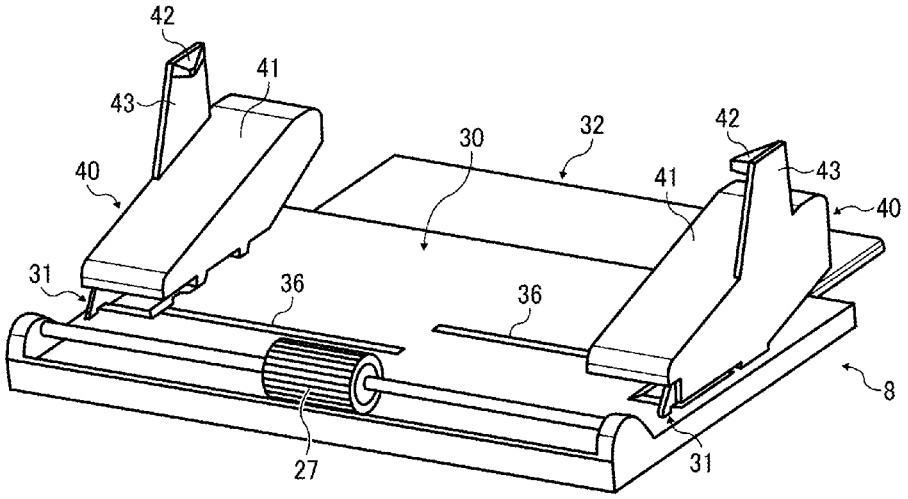
FIG. 4 is a perspective view of a sheet feed tray of the sheet feed device to which a long sheet supporter is attached according to a first embodiment of the present invention.
Figure 5A:
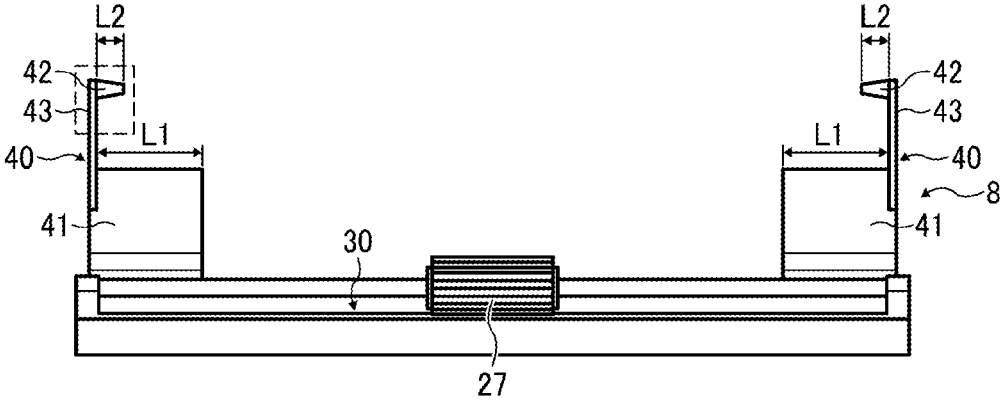
FIG. 5A is a front view of the sheet feed tray to which the long sheet supporter is attached.
Figure 5B:
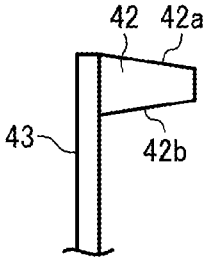
FIG. 5B is an enlarged partial view of a second support portion of the sheet feed tray.
Figure 6A:
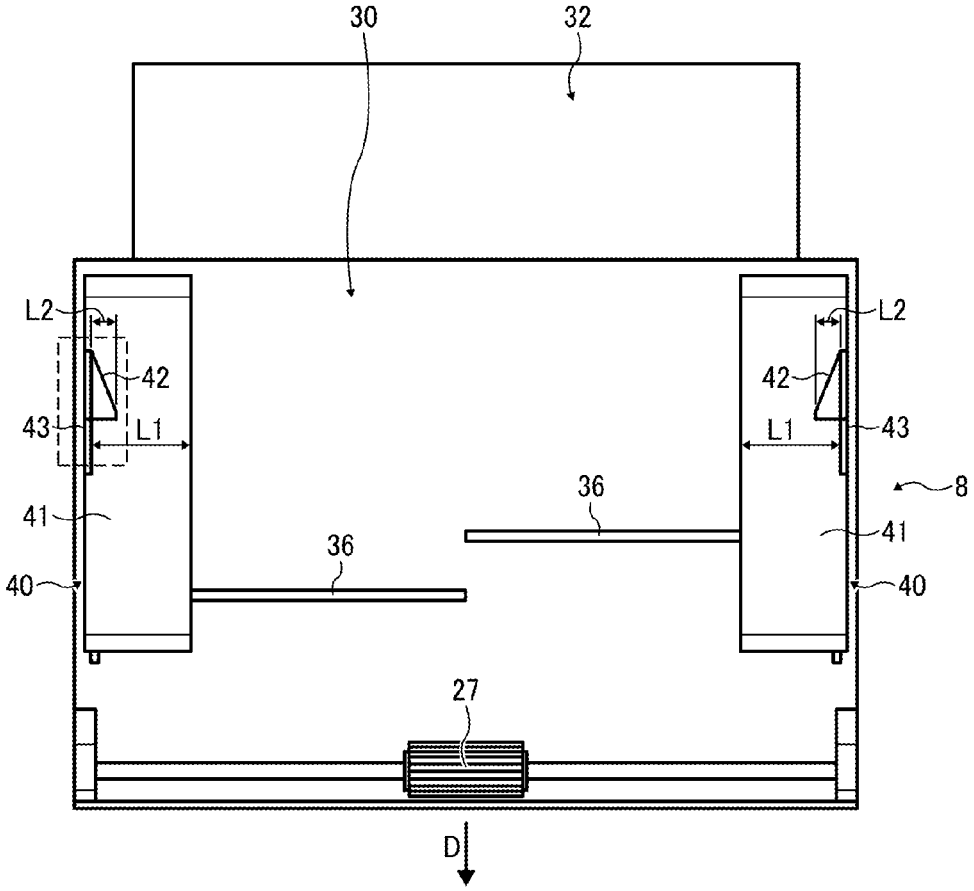
FIG. 6A is a plan view of the sheet feed tray to which the long sheet supporter is attached.
Figure 6B:
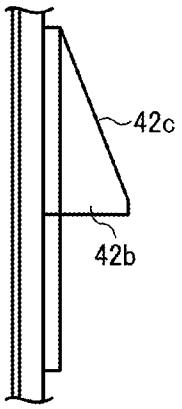
FIG. 6B is an enlarged partial view of the second support portion of the sheet feed tray.
Figure 7A:
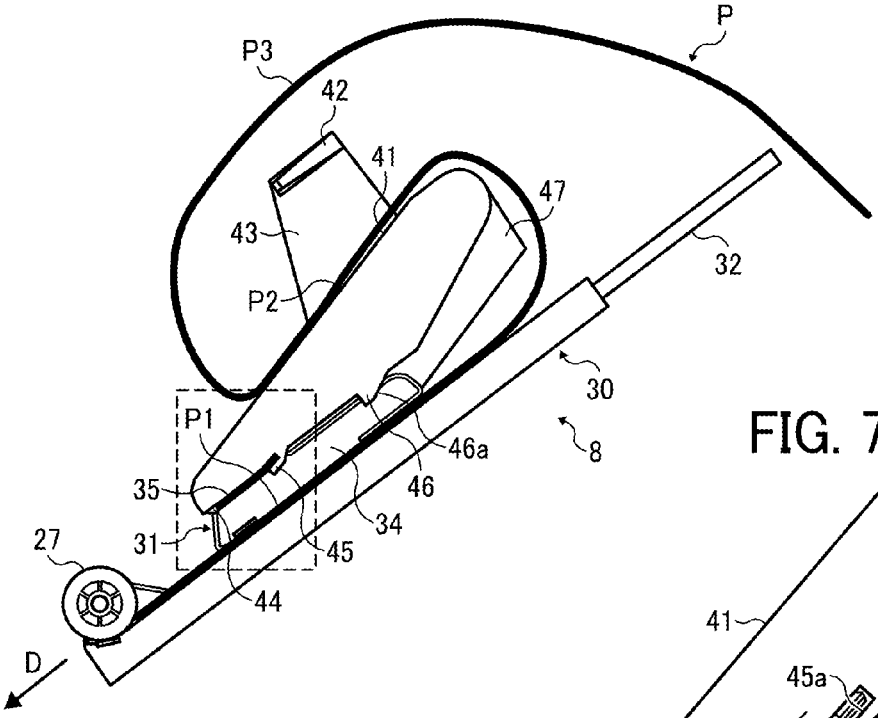
FIG. 7A is a cross-sectional side view of the sheet feed tray on which a long sheet is set.
Figure 7B:
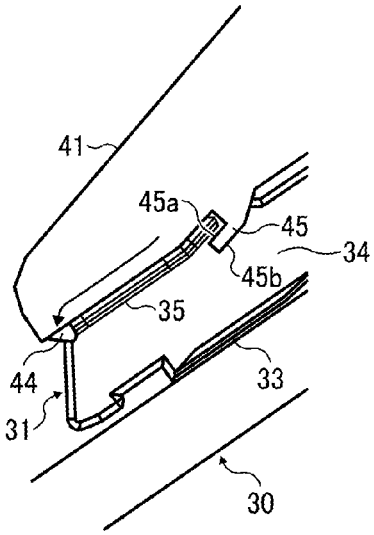
FIG. 7B is an enlarged partial view of the sheet feed tray.
Figure 8:
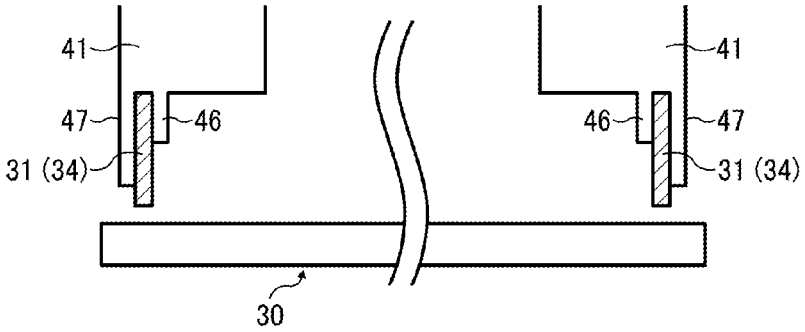
FIG. 8 is an enlarged partial view of the long sheet supporter illustrating a main section thereof.

FIG. 4 is a perspective view of a sheet feed tray to which a long sheet supporter is attached; FIG. 5A is a front view of the sheet feed tray to which the long sheet supporter is attached; FIG. 5B is an enlarged partial view of a second support portion of the sheet feed tray; FIG. 6A is a plan view of the sheet feed tray to which the long sheet supporter is attached; FIG. 6B is an enlarged partial view of a second support portion of the sheet feed tray; FIG. 7A is a cross-sectional side view of the sheet feed tray on which a long sheet is set; FIG. 7B is an enlarged partial view of the sheet feed tray; and FIG. 8 is an enlarged partial view of the long sheet supporter illustrating a main section thereof.

As illustrated in FIG. 4, a pair of long sheet supporters 40 is attached to the pair of side fences 31, respectively, and reciprocally moves integrally with each side fence 31 along the sheet width direction. In addition, each long sheet supporter 40 is symmetrically disposed each other and includes a first support portion 41, a side plate 43 that rises vertically from an upper surface of the first support portion 41, and a second support portion 42 disposed at an upper end of the side plate 43. Herein, the terms "upper surface" and "upper end" mean the upper positions when the manual sheet feed tray 8 is horizontally set as illustrated in FIG. 4 or when the manual sheet feed tray 8 is open as illustrated in FIG. 2.

As illustrated in FIGS. 5A and 6A, both the first support portion 41 and the second support portion 42 are disposed at the same side (that is, a center side) of the sheet width direction relative to the side plate 43. Herein, a length L1 of the first support portion 41 that is nearer to the center from the side plate 43 is longer than a length L2 of the second support portion 42 toward the center from the side plate 43.

As illustrated in FIG. 7A, the first support portion 41 and the second support portion 42 support a portion of the sheet folded back above the main body 30 when the longer sheet P is folded and placed. More specifically, a leading end portion of the sheet in the sheet feed direction to be placed on the main body 30 is referred to P1, that is, a first portion; a second portion P2 is an upwardly folded portion of the sheet at the trailing end of P1; and a third portion P3 is an upwardly folded portion of the sheet at the trailing end of P2. The first support portion 41 supports the second portion P2 and the second support portion 42 supports the third portion P3. It is noted that, in FIG. 8, the third portion P3 does not contact the second support portion 42, but when the third portion P3 bents downwardly or when a curvature of the sheet at a folded portion becomes large, the third portion P3 contacts the second support portion 42 and is supported thereby.

Figure 9A:
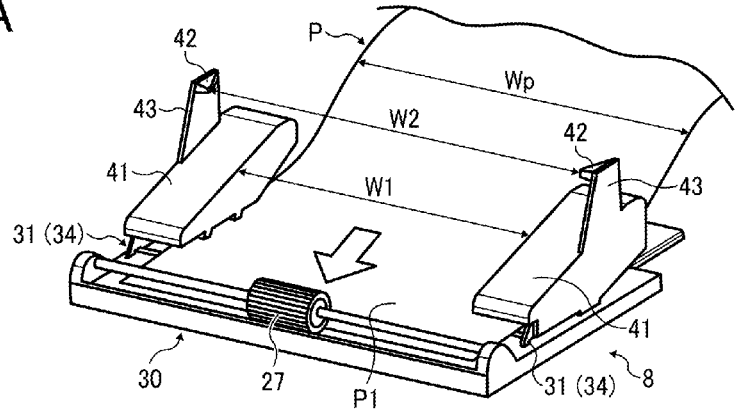
FIGS. 9A to 9C illustrate procedures to place a sheet on the sheet feed tray.

Next, with reference to FIGS. 9A to 9C, a process to place the sheet on the sheet feed tray according to the first embodiment will be described.

First, the manual sheet feed tray 8 is opened so that the sheet can be placed thereon. Next, as illustrated in FIG. 9A, a distance between the side walls 34 of the pair of side fences 31 is widened to be greater than the sheet width Wp, and the first portion P1 of the sheet P is placed on the main body 30 such that the leading end of the sheet reaches the position of the manual sheet feed roller 27. Then, the positions of the side fences 31 are adjusted such that a distance W1 between the pair of first support portions 41 is smaller than the sheet width Wp and a distance W2 between the pair of second support portions 42 is greater than the sheet width Wp. The adjustment of the distance between the side walls 34, the distances W1 and W2 described above may be conducted simultaneously.

Figure 9B:
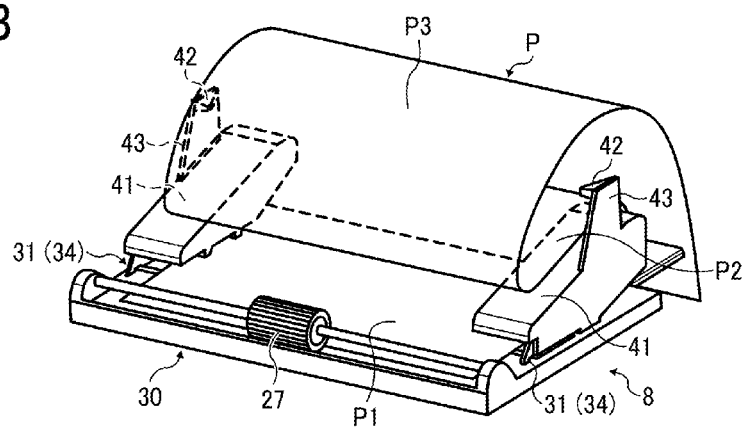

More specifically, as illustrated in FIG. 9B, the sheet P is folded upwardly at the trailing end of the sheet P1 placed on the main body 30, the folded portion that is the second portion P2 is bent toward front, the bent portion is passed through a space between the second support portions 42 from above, and the sheet P is placed on the first support portion 41. Further, the second portion P2 placed on the first support portion 41 is folded upward at the trailing end of the sheet P, and the folded portion that is the third portion P3 is bent toward a backside and is placed above the second support portion 42.

Figure 9C:
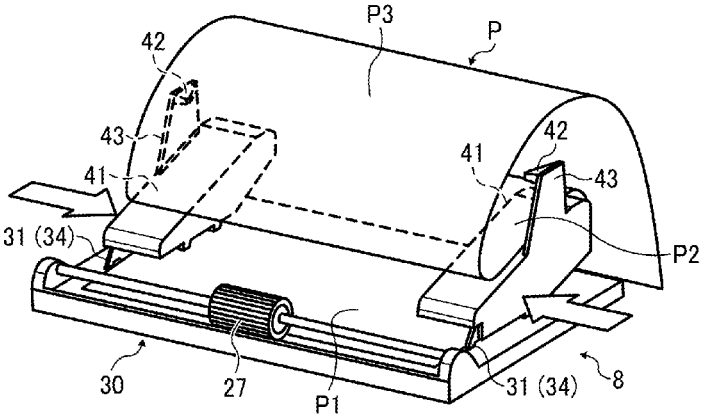

Then, as illustrated in FIG. 9C, the pair of side fences 31 is moved toward each other, so that the sheet P contacts or approaches the proximate one of the pair of side walls 34 and the pair of side plates 43 in the sheet width direction. As a result, the widthwise position of the sheet P is defined by the side walls 34 and the side plates 43.

Figure 10:
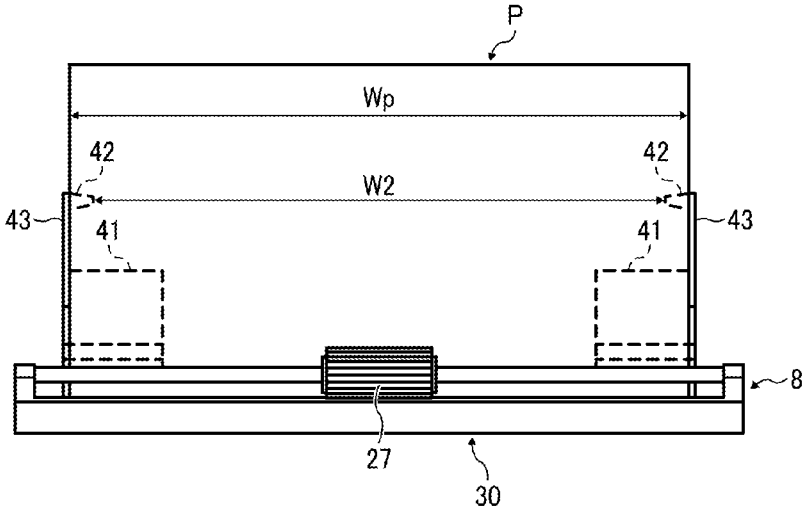
FIG. 10 illustrates a state in which a pair of side plates contacts or approaches lateral ends of the sheet width direction.

In addition, when the pair of side plates 43 contact both widthwise lateral ends of the sheet P, the distance W2 between the pair of second support portions 42 becomes shorter than the sheet width Wp as illustrated in FIG. 10, so that the sheet P, that is, the third portion P3 can be supported by the second support portion 42. Further, in this state, the second portion P2 placed on the first support portion 41 is prevented from moving upward by the second support portion 42.

As described above, the long sheet is placed in the sheet feed tray.

Because the sheet feed tray according to the first embodiment of the present invention is configured such that the length L2 of the second support portion 42 is shorter than the length L1 of the first support portion 41, the distance between the pair of second support portions 42 is wider than the distance between the pair of first support portions 41. Thus, the first support portions 41 can be respectively disposed across a distance narrower than the sheet width Wp whereas the second support portions 42 can be respectively disposed across a distance greater than the sheet width Wp. As a result, the second portion P2 of the sheet P can be easily placed on the first support portion 41 while preventing contact with the second support portion 42 by passing the sheet P through a portion between the pair of second support portions 42.

Figure 31:
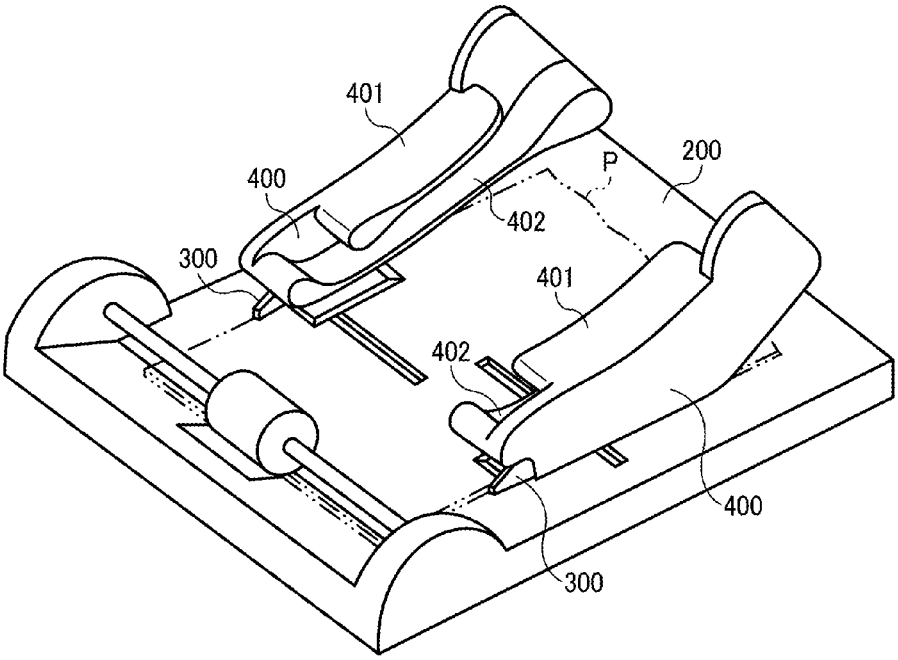
FIG. 31 BACKGROUND ART
FIG. 31 is a perspective view of a conventional sheet feeder.
Figure 32:
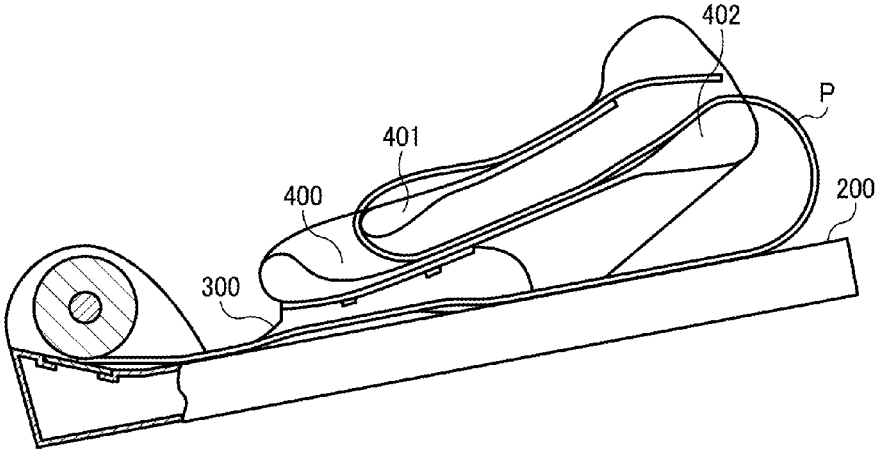
FIG. 32 BACKGROUND ART
FIG. 32 is a cross-sectional side view of the conventional sheet feeder on which a long sheet is set.

By contrast, in the conventional structure as illustrated in FIG. 31, an upper guide plate 401 and a lower guide plate 402 have substantially the same length, so that the lower guide plates 402 cannot be respectively across a distance narrower than the sheet width and the upper guide plates 401 cannot be respectively across a distance greater than the sheet width. Accordingly, it is difficult to pass the sheet through a portion between the upper guide plates 401 and place the sheet on the lower guide plates 402. As a result, in the conventional structure, the sheet needs to be passed between the upper guide plates 401 and the lower guide plates 402, and the sheet cannot be placed conveniently. By contrast, in the sheet feed tray according to the first embodiment, the sheet need not be passed between the pair of first support portions 41 and the pair of second support portions 42, so that the sheet can be placed easily.

In addition, as illustrated in FIG. 5B which is an enlarged partial view of FIG. 5A, the second support portion 42 includes an upper surface 42*a* slanted downward toward the center in the sheet width direction, that is, toward right in FIGS. 5A and 5B and a lower surface 42*b* slanted upward toward the widthwise center. In addition, the second support portion 42 opposite the second support portion 42 as illustrated in FIG. 5B is similarly constructed. The upper surface 42*a* and the lower surface 42*b* of the second support portion 42 are both slanted. When the pair of side fences 31 approaches each other as illustrated in FIG. 9C, the second support portions 42 do not get hung up on the both lateral ends of the sheet. With this structure, the sheet is prevented from the damage due to contacting the second support portions 42 and laying out the second support portions 42 can be performed easily.

In addition, as illustrated in FIG. 6B which is an enlarged partial view of FIG. 6A, the second support portion 42 includes a surface 42*c* slanted toward the proximal side (that is, a bottom side in FIGS. 6A and 6B) and the widthwise center of the sheet. The second support portion 42 opposite the second support portion 42 as illustrated in FIG. 6B is similarly constructed. Thus, because the surface 42*c* facing the widthwise center of the sheet is slanted, the second portion P2 which is bent frontward is prevented from contacting the second support portions 42 when the sheet is placed on the first support portion 41, thereby reducing the damage due to contacting the second support portions 42 and making the placement of the sheet easier.

In addition, in the present embodiment, the long sheet supporters 40 are detachably attached to the side fences 31, respectively. Specifically, as illustrated in FIG. 7B which is an enlarged partial view of FIG. 7A, a first projection 44 and a second projection 45 as engagement parts to engage the upper wall 35 of the side fence 31 are disposed on the bottom face of the first support portion 41. The first projection 44 and the second projection 45 are disposed in the front-back direction, the first projection 44 engages a front edge of the upper wall 35, and the second projection 45 engages a rear edge of the upper wall 35. In particular, the rear, second projection 45 includes a hook-like projection 45*a* that protrudes downward and bent frontward.

As illustrated in FIG. 7B, when the first projection 44 is moved frontward along the upper wall 35, the first projection 44 falls down at the front edge of the upper wall 35 and engages the front edge, and the hook-like projection 45*a* of the second projection 45 creeps along the bottom rear edge of the upper wall 35 and engages the rear edge. With this structure, upon mounting of the long sheet supporter 40 to the side fence 31 is complete, front-back direction movement of the long sheet supporter 40 relative to the side fence 31 and upward detachment of the long sheet supporter 40 are prevented. In addition, when the long sheet supporter 40 is removed from the side fence 31, the front edge of the long sheet supporter 40 is moved vertically to disengage the first projection 44, and the long sheet supporter 40 is moved backward to disengage the second projection 45.

Further, in the present embodiment, because movement of the sheet width direction needs to be prevented, a third projection 46 is disposed as an engagement part (see FIG. 7A). The third projection 46 is disposed on the bottom face of the first support portion 41 behind the second projection 45.

As illustrated in FIG. 8, each third projection 46 is disposed at an interior side of a side wall 47 extending downward from the bottom face of the first support portion 41. With this layout in which the side walls 47 and the third projections 46 sandwich the side walls 34 of the side fences 31, movement of the long sheet supporter 40 relative to the side fences 31 is prevented. As a result, the widthwise position of the sheet supported by the long sheet supporter 40 can be accurately defined, so that the sheet can be prevented from passing obliquely.

In the present embodiment, the second projection 45 and the third projection 46 include a face 45*b* (see FIG. 7B) and a face 46*a* (see FIG. 7A), respectively, that protrude from the upper wall 35 toward the main body 30. Each face 45*b*, 46*a* includes a frontward, slanted surface to approach the main body 30. Because the projected faces 45*b*, 46*a* are slanted, the front end of the sheet does not get hung up on the second projection 45 or the third projection 46 when the sheet is placed on the main body 30. Thus, the damage of the sheet is reduced and the placement of the sheet can be performed easily. The angle of inclination between the slanted faces and a sheet feed direction D (see FIG. 7A) should be preferably 30 degrees or less.

Next, a second embodiment which is different from the first embodiment will be described, focusing on the differences from the first embodiment.

Figure 11:
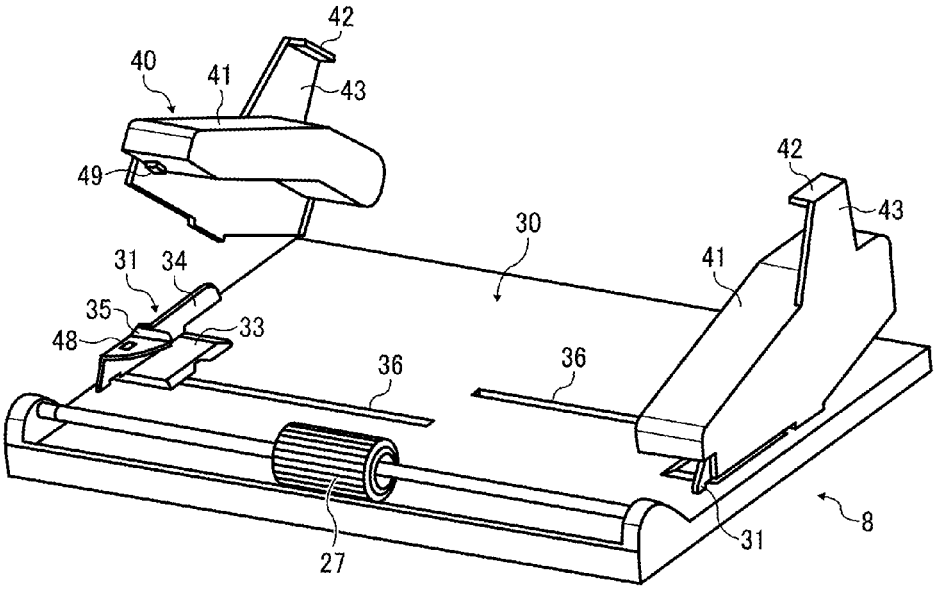
FIG. 11 is a perspective view illustrating a sheet feed tray according to a second embodiment of the present invention.
Figure 12:
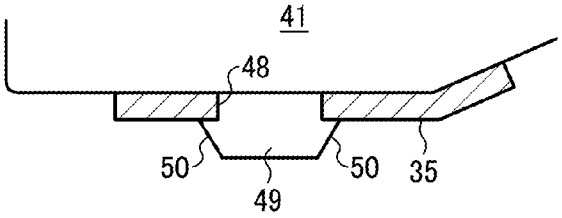
FIG. 12 is an enlarged cross-sectional view of the sheet feed tray illustrating a main section thereof according to the second embodiment.

FIGS. 11 and 12 illustrate the second embodiment of the present invention. The second embodiment is in particular different from the first embodiment in the mounting structure of the long sheet supporter 40 relative to the side fence 31. In the second embodiment, as illustrated in FIG. 11, a rectangular opening 48 is disposed on the upper wall 35 of the side fence 31. The long sheet supporter 40, on the other hand, includes a cuboid or cubic projection 49 disposed below the first support portion 41. The projection 49 can be inserted in the opening 48.

As illustrated in FIG. 12, the projection 49 includes pawls 50 at front and rear. When the projection 49 is inserted in the opening 48 of the upper wall 35, the pawls 50 engage edges of the opening 48. With this structure, front-back movement of the long sheet supporter 40 relative to the side fence 31 and upward detachment of the long sheet supporter 40 are prevented. In addition, because the engagement is done between the rectangular opening 48 and the cuboid or cubic projection 49, rotation about the insertion direction is also prevented. Thus, according to the second embodiment, the long sheet supporter 40 can be securely mounted to the sheet feed tray similarly to the first embodiment.

Figure 13:
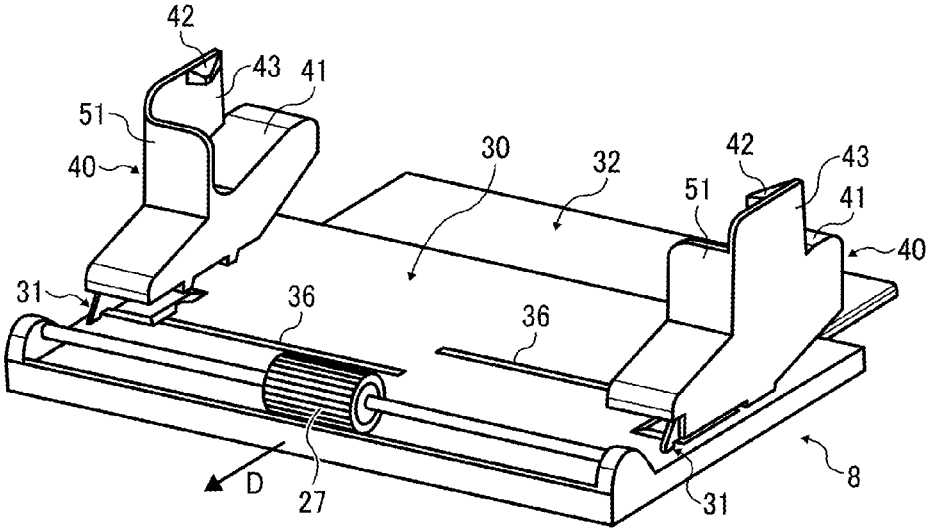
FIG. 13 is a perspective view of a sheet feed tray according to a third embodiment of the present invention.
Figure 14:
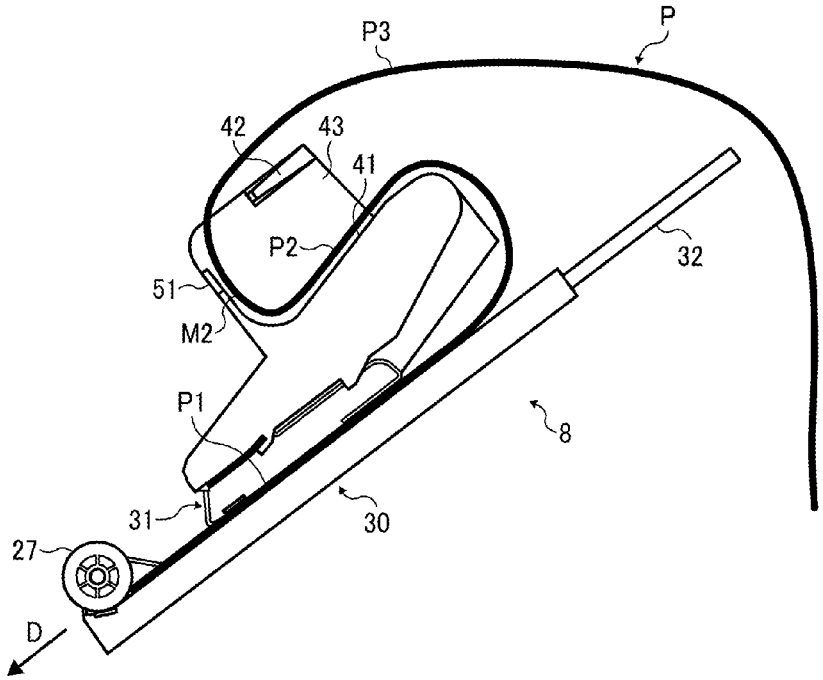
FIG. 14 is a cross-sectional side view of the sheet feed tray on which a long sheet is set according to the third embodiment.

FIGS. 13 and 14 illustrate a third embodiment of the present invention.

In the third embodiment, as illustrated in FIG. 13, a rising part 51 that vertically extends along the front edge of the side plate 43 is disposed on the first support portion 41. In addition, the rising part 51 according to the third embodiment is integrally formed with the side plate 43 and has the same width as that of the first support portion 41.

As illustrated in FIG. 14, because the rising part 51 is disposed in the third embodiment, when the sheet P is folded and is placed, the rising part 51 can support a folded portion M2 between the second portion P2 and the third portion P3. In addition, when the sheet P is placed on the first support portion 41, the sheet P can be folded while pressing against the rising part 51, thereby making the placement of the sheet easier.

Figure 15:
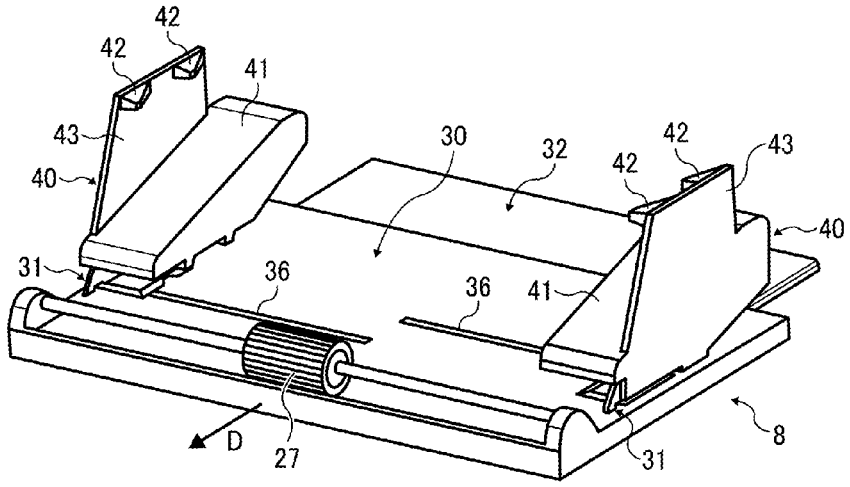
FIG. 15 is a perspective view of a sheet feed tray according to a fourth embodiment of the present invention.
Figure 16:
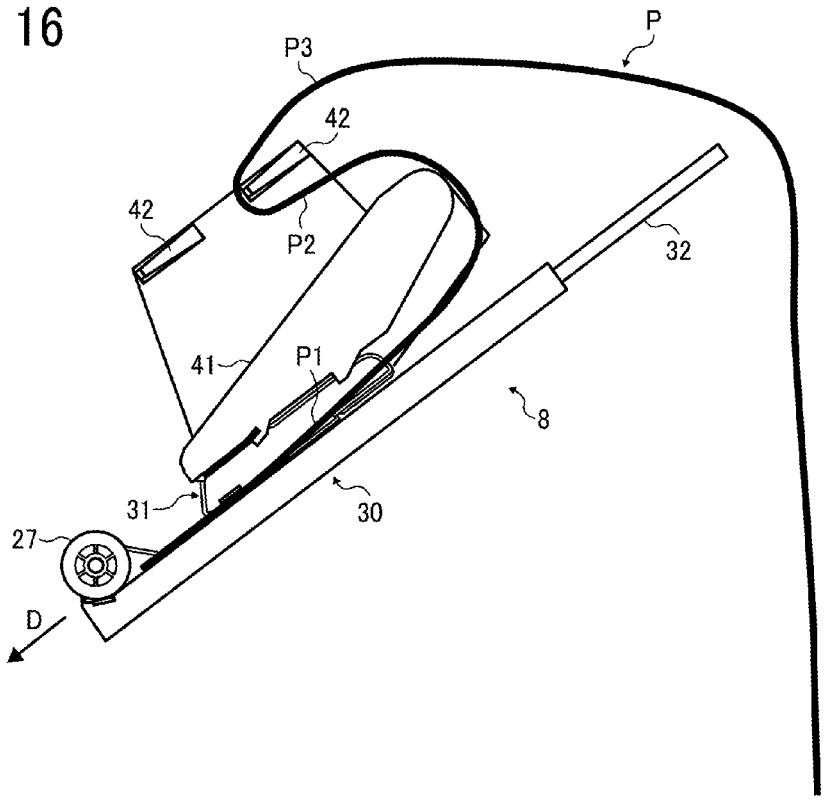
FIG. 16 is a cross-sectional side view of the sheet feed tray supporting a long sheet by a distal second supporter.
Figure 17:
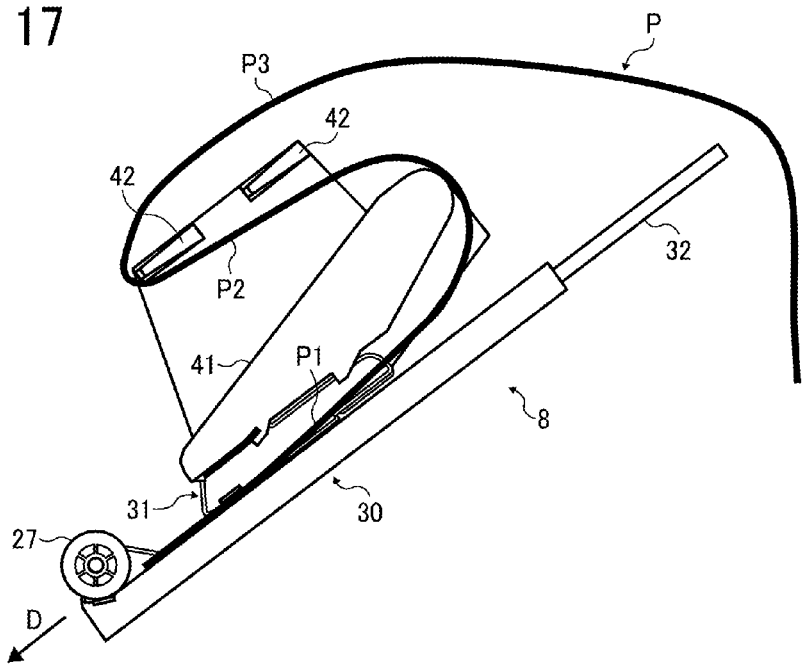
FIG. 17 is a cross-sectional side view of the sheet feed tray supporting a long sheet by a proximal second supporter.

FIGS. 15 to 17 illustrate a fourth embodiment of the present invention.

In the fourth embodiment, as illustrated in FIG. 15, two second support portions 42 are disposed on the side plate 43 in the front-back direction.

In this case, as illustrated in FIG. 16, the sheet P can be folded between the two second support portions 42. Alternatively, as illustrated in FIG. 17, the sheet P can be folded before the front second support portion 42. However, in the case of FIG. 16, depending on the length of the sheet P, the placed sheet may be pulled by its own weight toward back and fall. In this case, as illustrated in FIG. 17, the sheet can be folded before the front second support portion 42, so that the fallen portion of the sheet is reduced, thereby preventing the sheet from falling down. As a result, the sheet can be stably supplied. In the fourth embodiment, two second support portions 42 are disposed in the front-back direction; however, three or more second support portions 42 may be employed.

Figure 18:
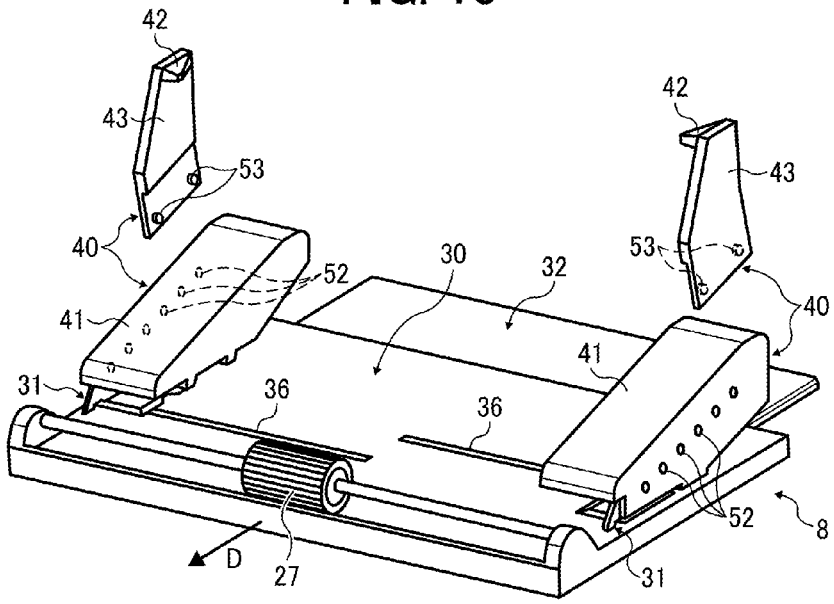
FIG. 18 is a perspective view of a sheet feed tray according to a fifth embodiment of the present invention.
Figure 19:
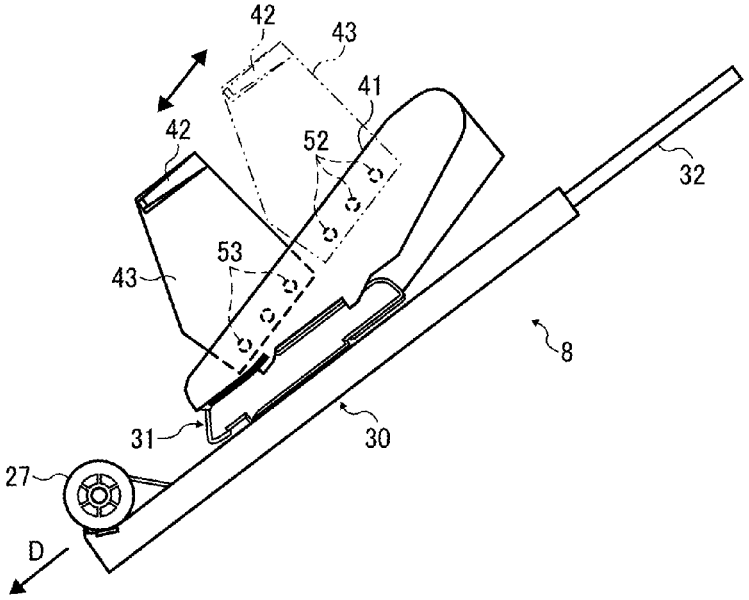
FIG. 19 is a cross-sectional side view of the sheet feed tray illustrating a state in which the second supporter is moved back and forth.

FIGS. 18 and 19 illustrate a fifth embodiment of the present invention.

In the fifth embodiment, as illustrated in FIG. 18, a plurality of recesses 52 are disposed on the side face of the first support portion 41 and the side plate 43 includes two convex portions 53 insertable to the recesses 52. The side plate 43 can be attached to the first support portion 41 by inserting the convex portions 53 in the recesses 52. In the present embodiment, two or more recesses 52 are disposed along the front-back direction of the first support portion 41.

As a result, as illustrated in FIG. 19, by changing back and forth the position of the recesses 52 in which the convex portions 53 are inserted, the position of the second support portion 42 is changed in the front-back direction. Accordingly, when the fallen length of the sheet from the manual sheet feed tray 8 is long, the mounting position of the side plate 43 can be changed to the proximal recesses 52 and the second support portion 42 is moved forward, so that the sheet P can be supported at a more proximal position as in the fourth embodiment and the sheet can be prevented from falling down. Even more, in the present fifth embodiment, because the number of the second support portion 42 to be disposed on the side plate 43 can be only one, so that the smaller side plate 43 can be disposed compared to the fourth embodiment employing the plurality of second support portions 42. It is noted that, contrary to the example as illustrated in FIGS. 19 to 21, the recesses 52 can be disposed on the side plate 43 and the convex portions 53 can be disposed on the side face of the first support portion 41.

Figure 20:
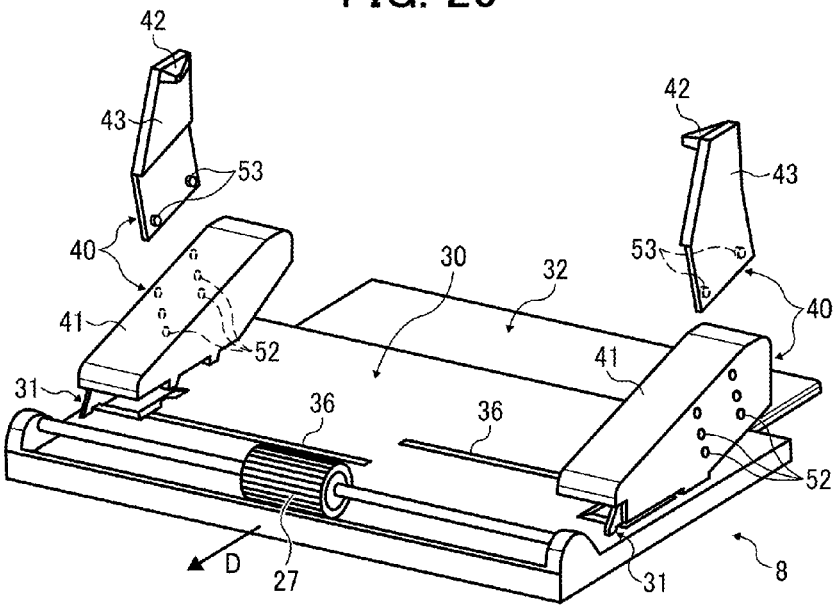
FIG. 20 is a perspective view of a sheet feed tray according to a sixth embodiment of the present invention.
Figure 21:
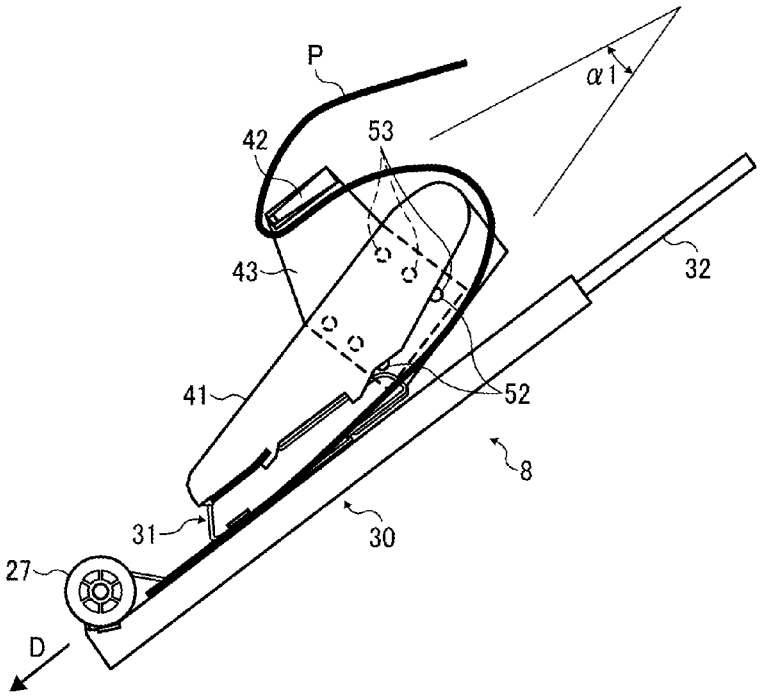
FIG. 21 is a cross-sectional side view of the sheet feed tray supporting a long sheet by the second supporter at a bottom portion.
Figure 22:
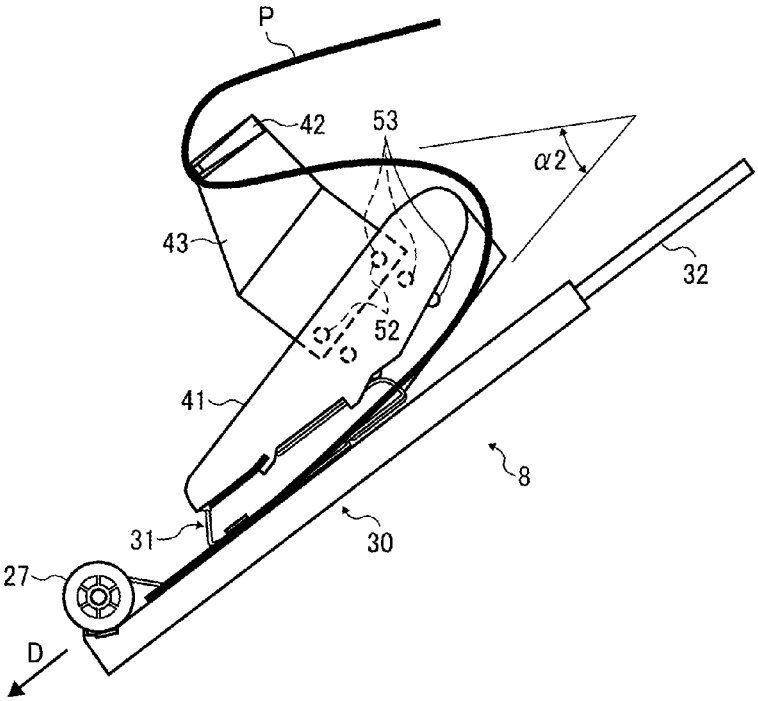
FIG. 22 is a cross-sectional side view of the sheet feed tray in which the second supporter supports a long sheet at an upper portion.

FIGS. 20 to 22 illustrate a sixth embodiment of the present invention.

In the sixth embodiment, as illustrated in FIG. 20, a plurality of recesses 52 are vertically disposed on the side face of the first support portion 41.

In this case, as illustrated in FIGS. 21 and 22, the positions of the recesses 52 in which the convex portions 53 are inserted can be changed in the vertical direction, the position of the second support portion 42 can be vertically changed along with the side plate 43. When the sheet with stiffness is placed, if an angle $\alpha 1$ to fold the sheet is small as illustrated in FIG. 21, a reaction force of the sheet to return to an original shape becomes greater, so that sticking force of the sheet to contact the bottom face of the second support portion 42 and the upper face of the main body 30 increases. As a result, two or more sheets may be conveyed in an overlapped manner. When such a phenomenon occurs, as illustrated in FIG. 22, a mounting position of the side plate 43 is changed and the second support portion 42 is moved upward, so that the sheet folding angle $\alpha 2$ can be greater, thereby decreasing the sticking force of the sheet to the bottom face of the second support portion 42 and the upper face of the main body 30 and preventing the overlapped conveyance of the sheet. Thus, in the sixth embodiment, the second support portion 42 can be moved to cope with the stiffness of the sheet variable depending on the thickness of each sheet and the stacked number of the sheets.

By employing the fifth embodiment and the sixth embodiment in combination, that is, by disposing the plurality of recesses 52 vertically in the front-back direction, the second support portion 42 can be moved both vertically and in the back and forth direction. In addition, movement of the second support portion 42 in the front-back direction or in the vertical direction can be realized by a structure, for example, in which the side plate 43 is configured to be slidable along a channel disposed on the first support portion 41, other than the structure in which the recesses 52 engage the convex portions 53.

FIGS. 23 to 26 illustrate a seventh embodiment of the present invention.

Figure 23:
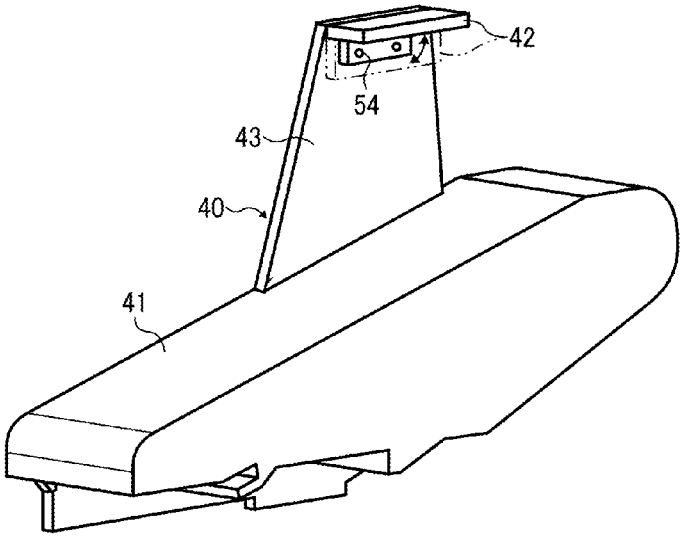
FIG. 23 is a perspective view of a sheet feed tray according to a seventh embodiment of the present invention.

As illustrated in FIG. 23, in the seventh embodiment, the second support portions 42 are rotatable about a rotary member 54 such as a hinge relative to the side plate 43. With this structure, the second support portion 42 is switchable between a substantially horizontal posture in which the sheet can be supported and a retracted posture in which the second support portion 42 is rotated downward by substantially 90 degrees from the horizontal posture.

Figure 24:
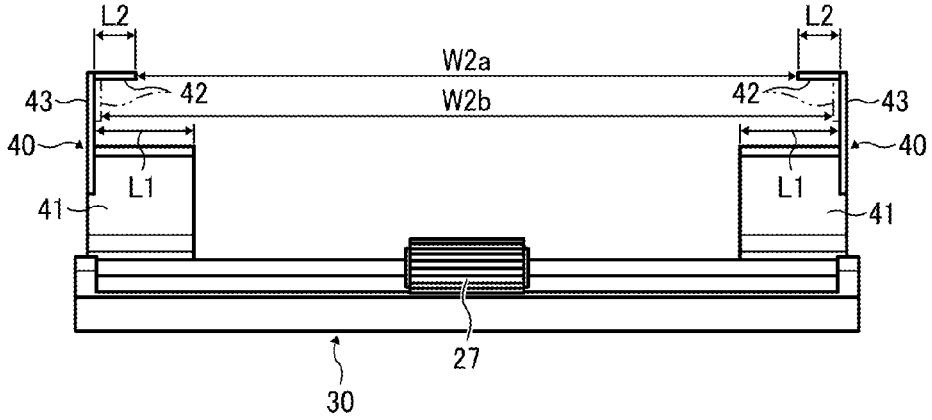
FIG. 24 is a front view of the sheet feed tray according to the seventh embodiment.
Figure 25:
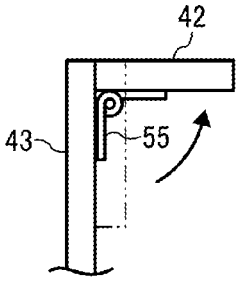
FIG. 25 is an enlarged front view of the sheet feed tray illustrating a main section thereof according to the seventh embodiment.

Accordingly, as illustrated in FIG. 24, the pair of second support portion 42 is transit from the supportable posture to the retracted posture, so that the distance between the second support portions 42 can be lengthened from W2a to W2b. Further, as illustrated in FIG. 25, a biasing member 55 is disposed at a joint portion between the second support portion 42 and the side plate 43. The biasing member 55 is, for example, a torsion spring to rotate the second support portion 42 upwardly, so that the second support portion 42 returns to the supportable posture automatically.

According to the present embodiment, when the sheet is folded and place on the first support portion 41, even when the sheet contacts from above the second support portion 42, the second support portion 42 rotates downward to take a retracted posture. As a result, the sheet does not receive any damage and can be place easily in the sheet feed tray 8. In addition, because the second support portion 42 returns to the supportable posture automatically by the biasing force of the biasing member 55, the second support portion 42 needs not be returned to the supportable posture manually and thus the operability is high.

Figure 26:
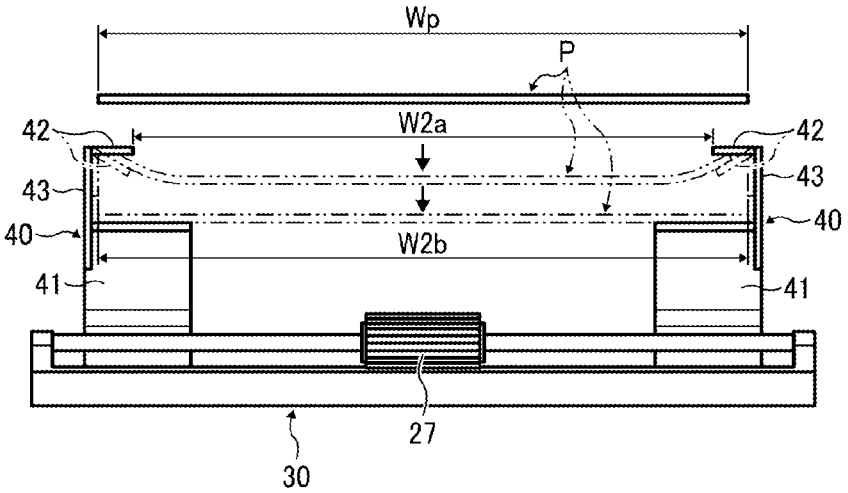
FIG. 26 is a front view illustrating a state in which a long sheet is set in the sheet feed tray according to the seventh embodiment.

Further, as illustrated in FIG. 26, even though the distance W2a between the second support portions 42 is narrower than the sheet width Wp, the sheet P can be pushed in from above and the second support portions 42 rotates downward, so that the distance W2a between the second support portions 42 can be lengthened. As a result, the sheet does not receive any damage and can be place easily on the first support portions 41.

Figure 27:
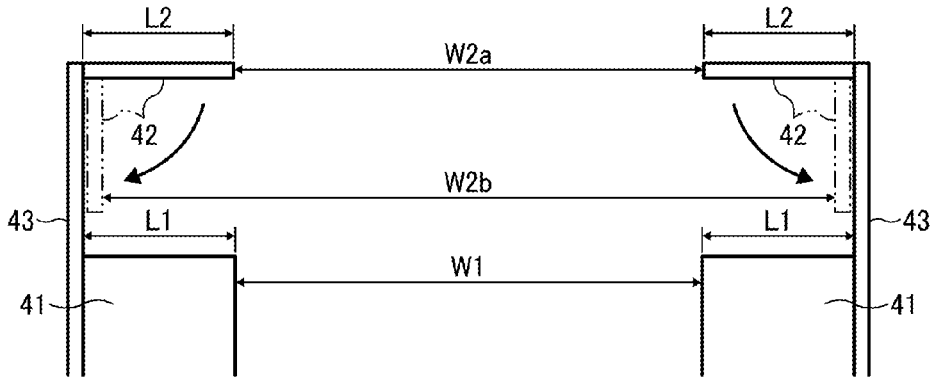
FIG. 27 is a view illustrating a modified example of the seventh embodiment.

In examples as illustrated in FIGS. 23 to 26, a length L2 of the first support portion 41 in the supportable posture is shorter than a length L1 of the first support portion 41. However, as illustrated in FIG. 27, these lengths L1 and L2 can be the same. In this case, the second support portion 42 is caused to rotate downward similarly to the case above, and the distance W2b between the second support portions 42 is made wider than the distance W1 between the first support portions 41. As a result, the sheet does not receive any damage and can be placed easily on the first support portions 41. In addition, if the distance W2b between the second support portions 42 can be made wider than the distance W1 between the first support portions 41, the length L2 of the second support portion 42 can be longer than the length L1 of the length of the first support portion 41.

Figure 28:
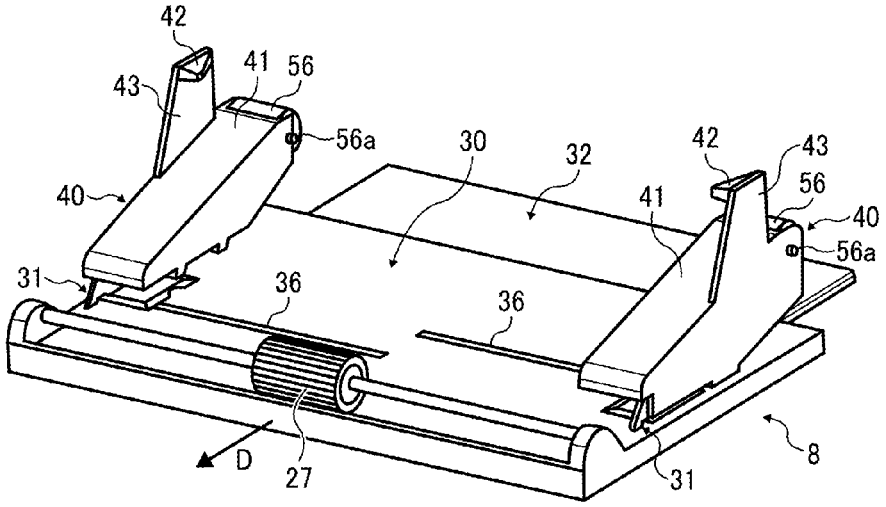
FIG. 28 is a perspective view of a sheet feed tray according to an eighth embodiment of the present invention.
Figure 29:
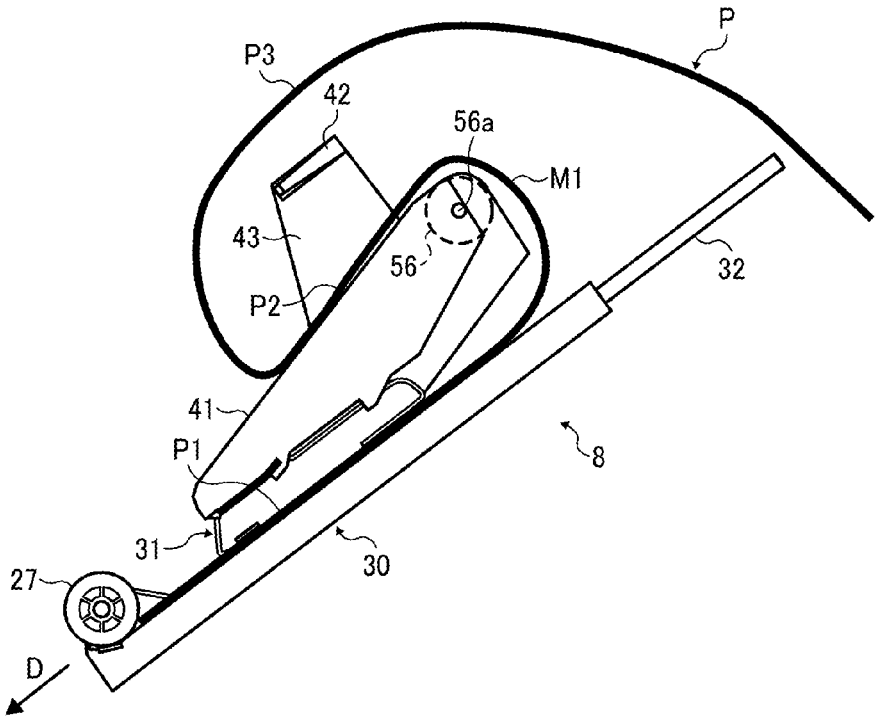
FIG. 29 is a cross-sectional side view of the sheet feed tray on which a long sheet is set according to the eighth embodiment.
Figure 30:
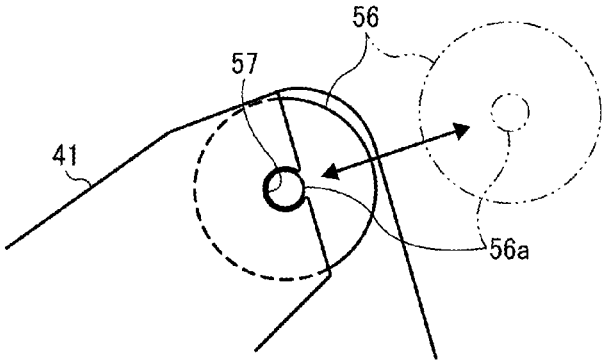
FIG. 30 is an enlarged side view of the sheet feed tray illustrating a main section thereof according to the eighth embodiment.

FIGS. 28 to 30 illustrate an eighth embodiment of the present invention.

In the eighth embodiment, as illustrated in FIG. 28, a rotary member 56 is disposed at a trailing end of the first support portion 41. The rotary member 56 includes a horizontal rotary axis 56*a* to be mounted to the first support portion 41 and pivots about the rotary axis 56*a*. In addition, as illustrated in FIG. 29, in a state in which the sheet P is folded and placed on the manual sheet feed tray 8, the rotary member 56 is disposed at a position opposite a folded portion M1 between the first portion P1 placed on the main body 30 and the second portion P2 placed on the first support portion 41. In this case, when the sheet P contacts the rotary member 56 in the sheet supply, because the rotary member 56 rotates, friction occurring in the conveyance of the sheet can be reduced and defective sheet feeding due to failed conveyance can be prevented from occurring.

In addition, as illustrated in FIG. 30, when the rotary axis 56*a* of the rotary member 56 is constructed to be detachably attachable to a mount hole 57, the rotary member 56 may be detachably attachable to the first support portion 41. With this structure, replacement of the rotary member 56 can be made easily any time abrasion of the rotary member 56 advances.

The present invention is not limited to the embodiments described heretofore, and can be applied to other embodiments modified in a range without distorting from the concept of the present invention. Further, among features described in each of the embodiments, two or more features can be selected and combined appropriately. Furthermore, the present invention is not limited to an application for a manual sheet feed tray but can be applied to a sheet feed tray on which standard size sheets are stacked. The present invention can also be applied to a document feeder to feed an original document to a scanner.

Additional modifications and variations of the present invention are possible in light of the above teachings. It is therefore to be understood that, within the scope of the appended claims, the invention may be practiced other than as specifically described herein.

What is claimed is:

1. A sheet feed tray to stack a sheet to be conveyed to an image forming apparatus, comprising:

a platen on which a first portion of the sheet is placed;

a pair of first support portions to support a second portion of the sheet folded back upward at a trailing end of the first portion of the sheet; and a pair of second support portions to support a third portion of the sheet folded back upward at a trailing end of the second portion, wherein the pair of first support portions and the pair of second support portions are reciprocally movable toward each other to support the sheet from the bottom, and a distance between the pair of second support portions is wider than a distance between the pair of first support portions to support the sheet from the bottom.

2. The sheet feed tray as claimed in claim 1, wherein an upper surface of each of the pair of second support portions is slanted downward toward a widthwise center of the sheet.

3. The sheet feed tray as claimed in claim 1, wherein a bottom face of each of the pair of second support portions is slanted downward toward a widthwise center of the sheet.

4. The sheet feed tray as claimed in claim 1, wherein each of the pair of second support portions includes a surface slanted toward a proximal side and a widthwise center of the sheet.

5. The sheet feed tray as claimed in claim 1, further comprising a pair of side fences that move reciprocally and define widthwise positions while contacting lateral ends of the sheet, wherein the pair of first support portions and the pair of second support portions are detachably attachable to the pair of side fences.

6. The sheet feed tray as claimed in claim 5, further comprising projections to engage upper wall areas of the pair of side fences and support the pair of first support portions and the pair of second support portions, wherein one of the projections includes a slanted face protruding from the upper wall of one of the pair of the side fences toward the platen of the tray.

7. The sheet feed tray as claimed in claim 1, further comprising a rising part disposed on the each of the pair of first support portions and configured to support a folded portion of the sheet between the second portion of the sheet and the third portion of the sheet.

8. The sheet feed tray as claimed in claim 1, further comprising a rotary member disposed at an end of each of the pair of first support portions opposite a sheet feed side that rotates while contacting a conveyed sheet.

9. The sheet feed tray as claimed in claim 1, wherein multiple pairs of second support portions are disposed upstream and downstream in a sheet conveyance direction in which the sheet is conveyed.

10. The sheet feed tray as claimed in claim 1, wherein the pair of second support portions are movably disposed in a sheet conveyance direction in which the sheet is conveyed.

11. The sheet feed tray as claimed in claim 1, wherein the pair of second support portions are movable vertically.

12. A sheet feed device comprising:

the sheet feed tray as claimed in claim 1; and a sheet feed unit to convey a sheet placed on the platen of the sheet feed tray to an image forming apparatus.

13. An image forming apparatus comprising:

an image forming section to form an image on a sheet; and the sheet feed device as claimed in claim 12 to feed the sheet to the image forming section.

14. A sheet feed tray to stack a sheet to be fed to an image forming apparatus, comprising:

a platen on which a first portion of the sheet is placed;

a pair of first support portions to support a second portion of the sheet folded upward at a trailing end of the first portion; and a pair of second support portions to support a third portion of the sheet folded upward at a trailing end of the second portion, wherein the pair of first support portions and the pair of second support portions are reciprocally movable toward each other in a sheet width direction, the pair of second support portions having a range of movement greater than the pair of first support portions.

15. The sheet feed tray as claimed in claim 14, wherein the pair of second support portions is switchable between a supporting posture supportable of the third portion and a retracted posture rotated downward so that the distance between the pair of second support portions in the retracted posture is wider than the distance between the pair of second support portions in the supporting posture.

16. The sheet feed tray as claimed in claim 15, further comprising a biasing member to rotate the pair of second support portions upward to return to the supporting posture.

* * * * *